United States Patent [19]

Sedivy

[11] 3,943,399

[45] Mar. 9, 1976

[54] SHADOW-MASK COLOR CATHODE RAY TUBE WITH IMPROVED MASK SUSPENSION SYSTEM

[75] Inventor: Stanley J. Sedivy, Chicago, Ill.

[73] Assignee: Zenith Radio Corporation, Chicago, Ill.

[22] Filed: Dec. 23, 1974

[21] Appl. No.: 535,473

Related U.S. Application Data

[63] Continuation-in-part of Ser. No. 395,106, Sept. 7, 1973, abandoned.

[52] U.S. Cl. ..... 313/404; 313/405; 313/288

[51] Int. Cl.[2] H01J 29/02; H01J 29/08; H01J 31/20

[58] Field of Search ..... 313/408, 292, 407, 284, 313/286, 288, 406, 405, 404

[56] References Cited

UNITED STATES PATENTS

| | | | |
|---|---|---|---|
| 3,330,980 | 7/1967 | Shrader | 313/405 |
| 3,497,746 | 2/1970 | Duistermaat et al. | 313/404 |
| 3,524,973 | 8/1970 | Rigdon | 307/288 |
| 3,529,199 | 9/1970 | Duistermaat et al. | 313/404 |
| 3,548,235 | 12/1970 | Driedijk | 328/178 |
| 3,796,904 | 3/1974 | Yamauchi et al. | 313/404 |

FOREIGN PATENTS OR APPLICATIONS

| | | |
|---|---|---|
| 32,495 | 7/1967 | Japan |

*Primary Examiner*—Robert Segal
*Attorney, Agent, or Firm*—John H. Coult

[57] ABSTRACT

This disclosure depicts a color cathode ray tube of the shadow mask type, and especially depicts suspension systems for detachably supporting a rectangular, non-self-rigid, torsionally flexible shadow mask on the envelope of a color cathode ray tube. Each suspension system illustrated includes four suspension devices, one at each corner of a faceplate portion of the envelope on a diagonal thereof, for mechanically coupling the shadow mask to the envelope. Each device comprises envelope-mounted means and mask-mounted means for retentively but detachably engaging the envelope-mounted means to cause the mask to assume a fixed position in space relative to the tube of the faceplate. In the preferred embodiment illustrated, the envelope-mounted means and the mask-mounted means mate with a snap-in, self-guiding, self-locating engagement such that the mask may be quickly and precisely mounted on the envelope by a push-click insertion operation.

43 Claims, 14 Drawing Figures

FIG. 4
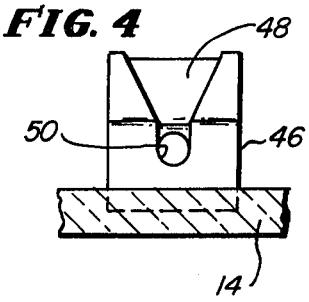
FIG. 5
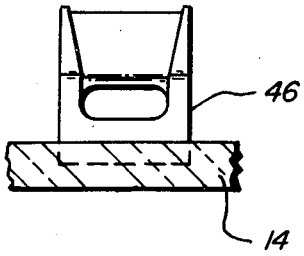
FIG. 6
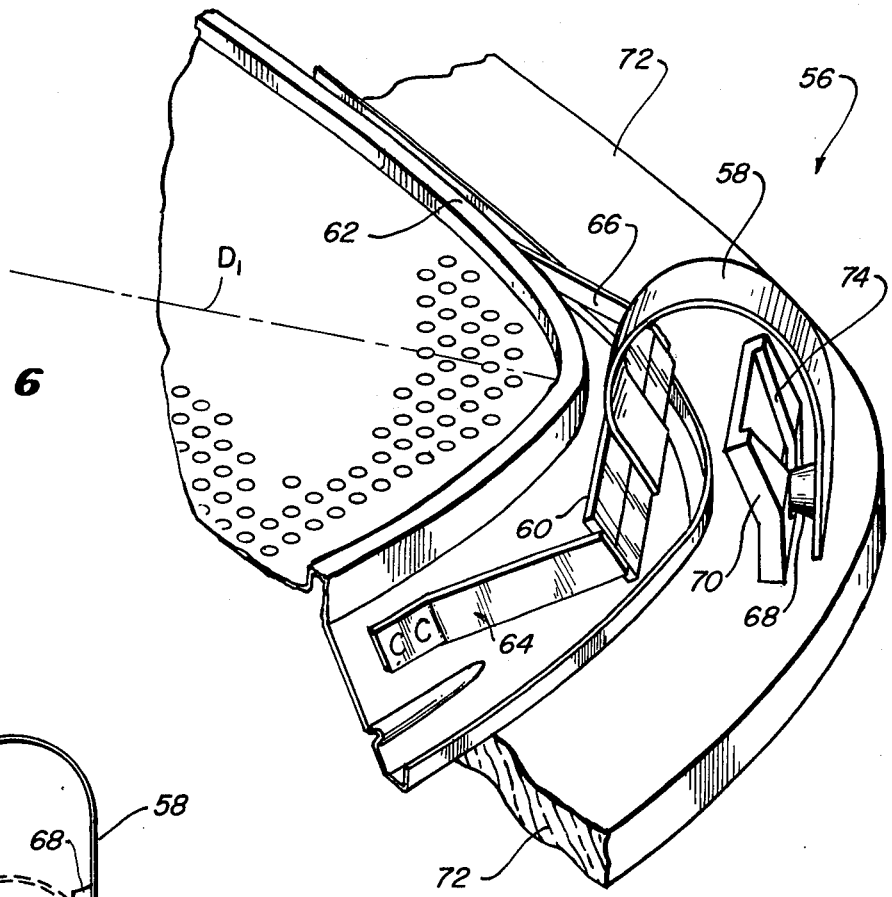
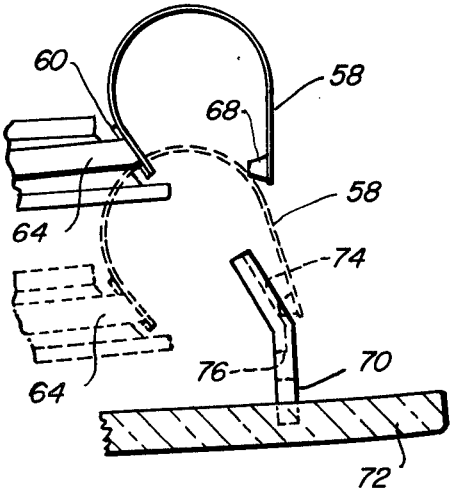
FIG. 7

FIG. A
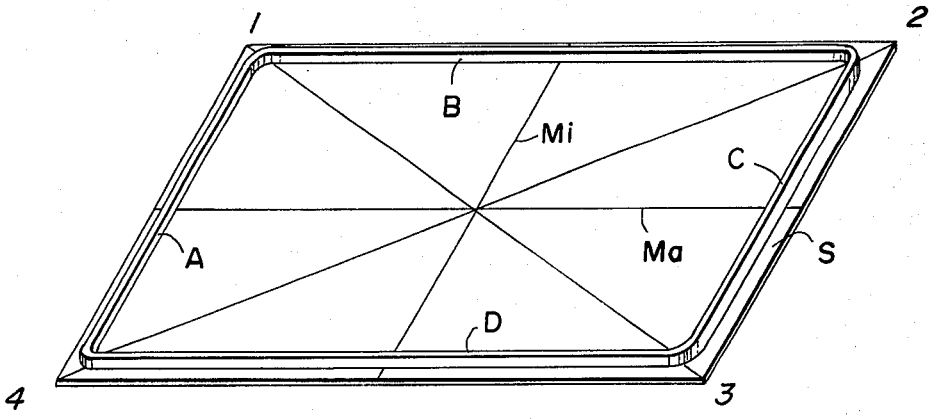
FIG. B
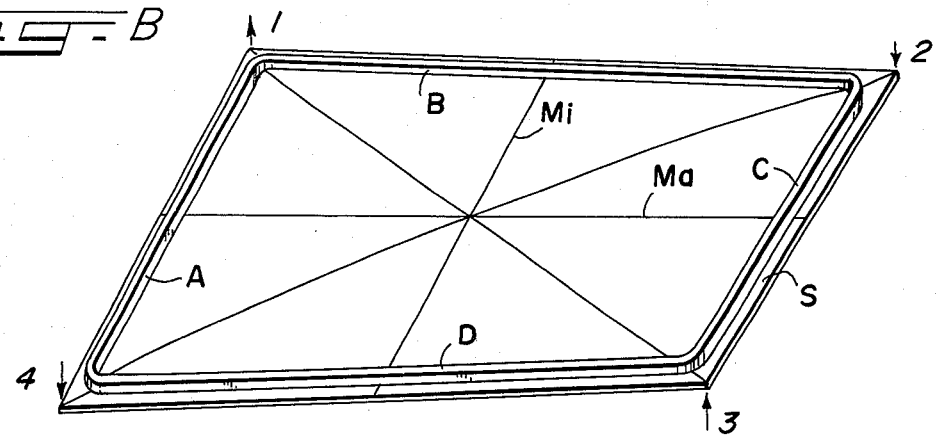
FIG. 5A
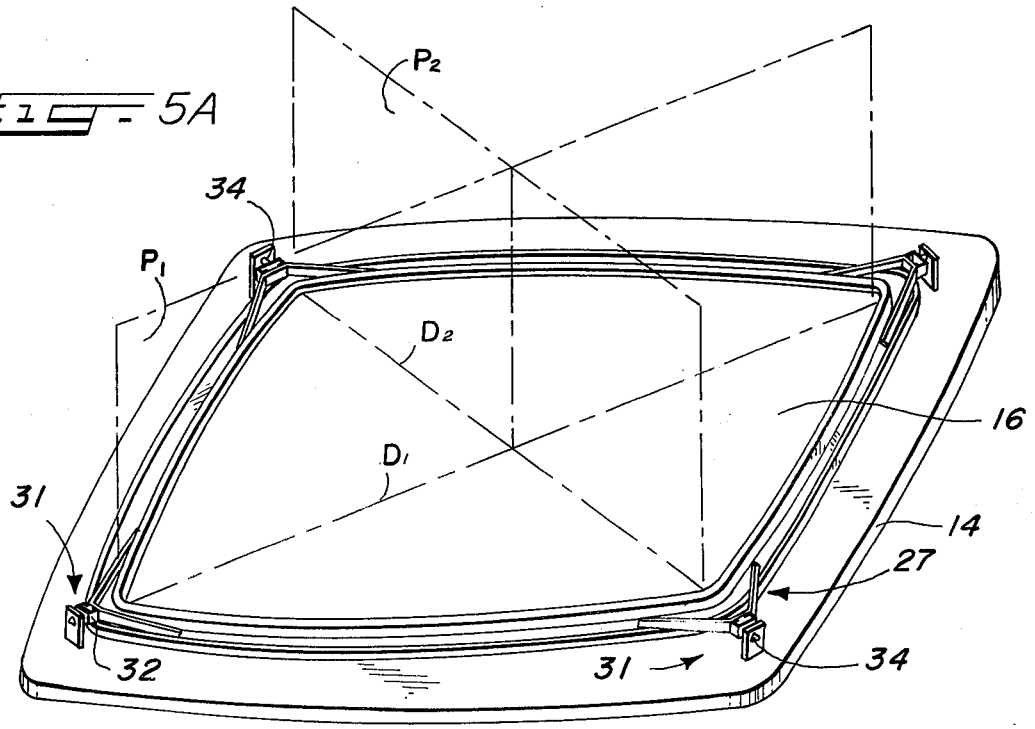

FIG. 8
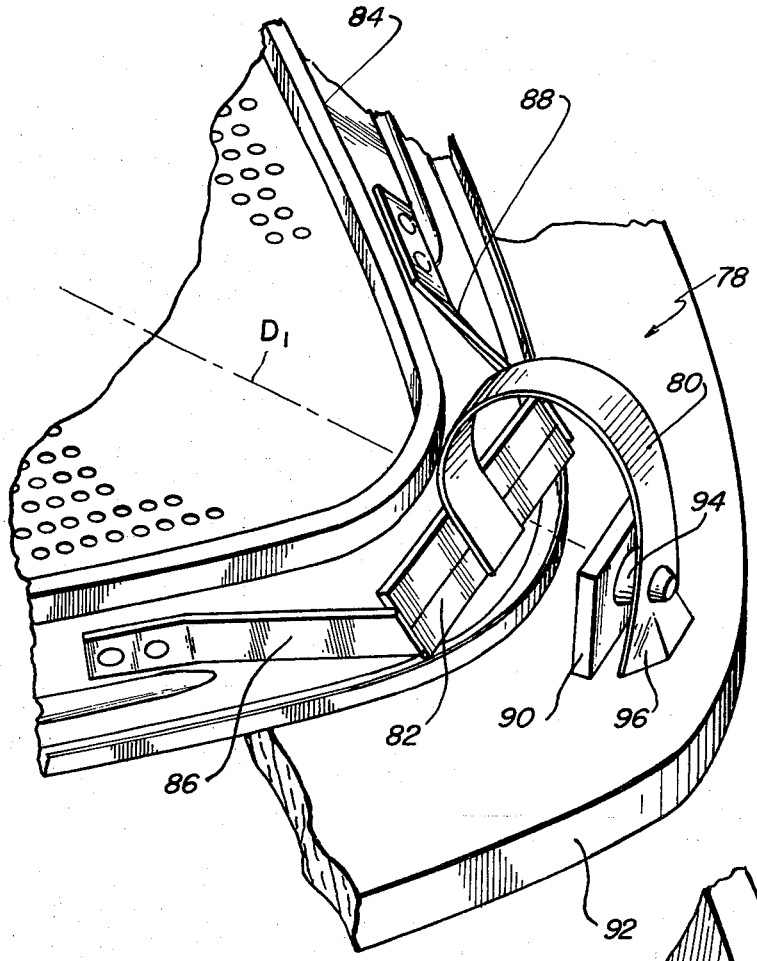
FIG. 9
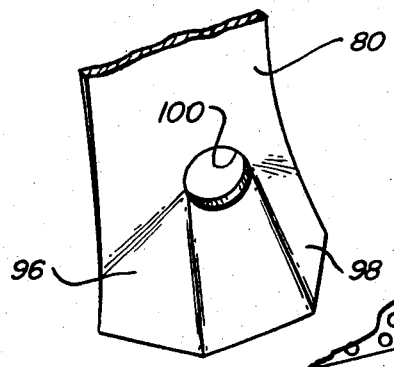
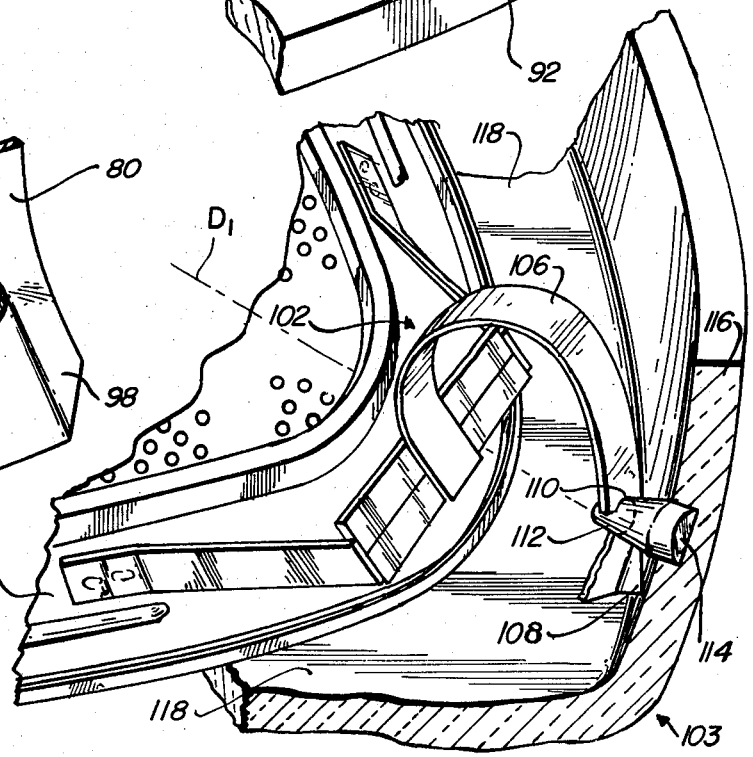
FIG. 10

SHADOW-MASK COLOR CATHODE RAY TUBE WITH IMPROVED MASK SUSPENSION SYSTEM

CROSS-REFERENCE TO RELATED APPLICATIONS

This application is a continuation-in-part of copending application Ser. No. 395,106, filed Sept. 7, 1973 (now abandoned) and is related to, but in no way dependent upon, copending applications Ser. No. 395,334, filed Sept. 7, 1973 (now U.S. Pat. No. 3,912,963), Ser. No. 424,018, filed Dec. 12, 1973 (now U.S. Pat. No. 3,894,260), and Ser. No. 285,985, filed Sept. 5, 1972 (abandoned in favor of continuation application Ser. No. 498,836, filed Aug. 19, 1974, all assigned to the assignee of the present invention.

BACKGROUND OF THE INVENTION

This invention relates to cathode ray tubes of the shadow mask type, and particularly to a system for suspending a shadow mask in such a tube.

In conventional color cathode ray tubes there is provided a shadow mask assembly including a heavy frame to which is welded a dished, apertured mask. The frame is, by design, extremely rigid and provides the necessary rigidity for the mask. The mask-frame assembly is mounted in a conventional tube by a suspension system comprising three or four leaf springs which are welded to the frame at spaced points around the periphery thereof. The springs have apertures at their distal ends which engage studs projecting inwardly from a rearward flange on the tube faceplate when the assembly is mounted in a tube. The mask-frame assembly is capable of being demounted and precisely remounted in a tube by depressing the springs to disengage the said studs. This type of system has proven to be commercially viable, however the mask-frame assembly is undesirably expensive.

A different type of shadow mask and suspension system therefor is disclosed in the patent to Fyler — U.S. Pat. No. 2,961,560. This patent shows a frameless shadow mask supported at a multiplicity of spaced peripheral points directly by the concave screen-bearing surface of the tube faceplate. By this approach, the rigidity of the faceplate is used, in effect, to impart rigidity to the mask, thus eliminating the necessity for the mask to also be rigid. This approach, as disclosed by Fyler, however, suffers, inter alia, (1) from an undue difficulty and inconvenience in the demounting and remounting of the shadow mask in the tube, as is required by conventional screening practices, (2) a difficulty in seating the mask uniformly on the multiplicity of support elements provided on the faceplate, (3) uncontrollability of the spatial position of the mask corners, and thereby a loss of color purity in the corners of the displayed images, (4) a shifting of the geometrical center of the mask upon thermal expansion and contraction thereof, due to the non-equalized, frictional retention of the mask in the Fyler mask mounting system, (5) difficulty in achieving a commercially satisfactory "Q" compensation of the mask, and (6) its relatively high cost of manufacture and assembly.

The present invention represents a departure from these and other prior art approaches. The best features of both approaches discussed are abstracted without also acquiring the disadvantageous qualities thereof. By the present approach, a low cost, lightweight, torsionally flexible mask is provided. The faceplate is used to impart the necessary rigidity to the mask. However, rather than affixing the mask directly to the faceplate, a novel suspension system is provided which furnishes a mechanically rigid link between the faceplate and the mask, and yet which permits the mask to be conveniently and repeatably demounted and precisely remounted in the tube.

A system of the type taught by this invention has imposed upon it a number of requirements and constraints not presented in conventional systems in which a rigid frame is used to impart rigidity to the mask. Before enumerating these requirements and constraints, a discussion of certain principles underlying this invention will be engaged, A shallow mask of the type with which this invention is concerned may be modeled as a rectangular four bar linkage affixed to a stiff but flexible sheet. Such a model is shown in FIG. A. The four rigid bars of the linkage are designated A, B, C and D; the sheet is labeled S. As is well known, a four bar linkage is not inherently a rigid structure. The rectangular four bar linkage, in its free state, might, e.g., quite easily be skewed into a parallelogram geometry. It is evident, however, that the FIG. A model cannot be skewed in its plane to take a parallelogram shape since it is affixed to the sheet S.

The linkage can, however, be torsionally twisted about its diagonals, as shown for example in FIG. B. In FIG. B, the model has been twisted as follows — the linkage bar A has been rotated toward the reader (see arrows); the linkage bar C has been rotated away from the reader. The corners 1 and 3 have been displaced upwardly and the corners 2 and 4 have been displaced downwardly. The sheet S is thus stressed convexly along diagonal 2–4 and somewhat concavely at the ends of diagonal 1–3. The model may thus be thought of as being twisted about one of its diagonals. It can be noted that the model configuration, after twisting, is changed substantially less along its major axis $M_a$ and minor axis $M_i$ than along the diagonal 2–4. Thus, a four bar linkage affixed to a flexible sheet is relatively stiff with respect to its major and minor axes (due to the rigidity of the bars), but is relatively flexible in torsion. When torsionally flexed (twisted) about its diagonals, the corners are displaced, but points on the major and minor axes remain relatively stationary.

As will be pointed out in more detail hereinafter, the lightweight shadow mask with which this invention is concerned closely corresponds to the described model in its mechanical characteristics.

The principles of this invention, though not limited to such application, are most useful when embodied in a color cathode ray tube having a flangeless faceplate. A flangeless faceplate, because of its lack of a stiffening flange, as found in conventional front panels, tends to vary in its shape from unit-to-unit. Specifically, flangeless faceplates will tend to vary (from unit-to-unit) in a twist-wise sense. Thus, one of the necessary requirements imposed on a mask intended for use with a flangeless faceplate is that it must be able to adapt to such twist-wise, tolerance-related deviations in a faceplate with which it is mated. Stated another way, the mask may be capable of flexing or twisting about its diagonals in the same way faceplates are apt to twist-wise vary from unit-to-unit in their contour. As will become evident as this description proceeds, the shadow mask with which this invention is concerned is uniquely capable of meeting this requirement.

Secondly, and of equal significance — with respect to any given faceplate, since the mask is non-self-rigid, the suspension system for the mask must effectively transfer the rigidity of the faceplate to the mask. The suspension system must also fix the spatial position relative to the inner surface of the faceplate in spite of repeated demountings and remountings thereof, and in spite of mechanical configuration shifts resulting from stress relieving of the mask and appurtenant structures. Further, the suspension system must be capable of substantially immobilizing the geometrical center of the mask upon thermal expansion and contraction thereof in order to prevent temperature-related color degradation in the reproduced pictures.

The afore-discussed Fyler (U.S. Pat. No. 2,961,560) mask suspension system, in addition to suffering from a mounting-demounting inconvenience and the other drawbacks described, demounting and remounting thereof during screening, suffers also from the manner in which it causes the mask to be suspended. The Fyler system utilizes six or more off-corner mask support points aand three mask indexing points (one on the mask minor axis and the other two in opposite corners of the mask). It is noted above in connection with the discussion of FIG. B, that it is the corners of a torsionally flexible mask which are uncontrollable, while points on the major and minor axes tend to remain relatively stationary. The Fyler patent fails to disclose mask suspension points at all corners of the mask. As will be easily understood from a consideration of FIGS. A and B, a suspension system of this nature does not control or arrest the corners of the mask adjacent that point, as it must. The result is that a suspension system of the Fyler type will be apt to have color purity errors, especially in the corners.

Further, because of the inherent (by design) non-self-rigid nature of the mask with which this invention is concerned, it may be easily distorted by excessive or improperly directed forces applied thereto. Also, such a mask is apt to undergo configurational changes during stress relief operations, and is otherwise easily influenced in its shape by forces exerted thereon. It is also desirable in a mask suspension system of the type taught by this invention that no force components, especially tangential force components, be imparted to the mask in the plane of the mask which might tend to rotate, mislocate, twist or distort the mask.

The present invention provides a detachable spring suspension system by which a non-self-rigid shadow mask is supported at its four corners. The teachings of the prior art, including the discussed Fyler patent would be totally inadequate to provide a commercially viable system for supporting a non-self-rigid mask of the type with which this invention is concerned. Because the structure and mounting requirements of this novel mask are so radically different from the prior art mask structures and mounting requirements, the mask suspension systems which have been developed for use in prior art tubes are not suitable for suspending the described novel mask.

OTHER PRIOR ART

| United States | British |
|---|---|
| 3,537,159 - Gartner | 1,278,633 |
| 3,529,199 - Duistermaat et al | 1,278,634 |
| 3,548,235 - Dridijk et al | 1,278,635 |
| 3,497,746 - Duistermaat et al | |
| 3,524,973 - Rigdon | |

-continued

| United States | British |
|---|---|
| 3,330,980 - Schrader | |
| 3,573,527 - Hafkenscheid et al | |
| 3,350,593 - Lindeman et al | |
| 2,222,197 - Engels | |
| 2,562,163 - Hiensch et al | |
| 2,922,063 - Haas | |

OBJECTS OF THE INVENTION

It is a general object of this invention to provide an improved suspension system for supporting a shadow mask in a color cathode ray tube.

It is a less general object of this invention to provide an improved shadow mask suspension system which is especially useful for suspending a novel rectangular mask of lightweight, non-self-rigid, torsionally flexible construction upon the envelope or directly upon the faceplate of a color cathode ray tube.

It is another object of this invention to provide such an improved shadow mask suspension system which is effective to accurately fix the position of the mask in space relative to a tube faceplate in spite of thermal expansion and contraction thereof, and to cause the mask to conform to twist-wise, tolerance-related deviations in flangeless-type faceplates.

It is another object to provide such a mask suspension system which is capable of suppressing the generation of tangential force components on the mask in the plane thereof which might tend to rotate, mislocate, twist or distort the mask.

It is still another object to provide a shadow mask suspension system which has the above-noted properties and features, and yet which occupies a modest amount of space within a tube, thus allowing the use of a more compact and less expensive tube envelope.

It is an important object to provide an improved shadow mask suspension system by which a mask may be quickly and precisely mountable on the faceplate of a color tube by a simple push-click insertion operation.

It is yet another object of this invention to provide a rapid-mount shadow mask suspension system which places the mask when mounted under tension and thus which minimizes the build-up of stresses in the mask during thermal cycling operations encountered during tube manufacture and during normal tube operation.

BRIEF DESCRIPTION OF THE DRAWINGS

The features of the invention which are believed to be novel and unobvious are set forth with particularity in the appended claims. The invention, together with further objects and advantages thereof, may best be understood by reference to the following description taken in conjunction with the accompanying drawings, in which:

FIGS. A and B are schematic diagrams of a four bar linkage model useful in understanding the mechanical properties of a shadow mask of the type with which this invention is concerned;

FIG. 4 illustrates a stud which constitutes a part of three of the four mask suspension devices utilized in the FIGS. 1–3 apparatus;

FIG. 5 illustrates a stud constituting a part of the fourth mask suspension device utilized in the FIGS. 1–3 apparatus;

FIG. 5A is a partially schematic view of a faceplate mask assembly shown in FIGS. 1–5; the figure is useful in understanding certain mask suspension principles which underlie this invention;

FIG. 6 is a perspective view of a mask suspension device representing another embodiment of the principles of this invention;

FIG. 7 is a partially sectioned side elevational view of the FIG. 6 device; and

FIGS. 8–9 and FIG. 10 illustrate yet other embodiments of this invention.

DESCRIPTION OF THE PREFERRED EMBODIMENT

Figure 1:
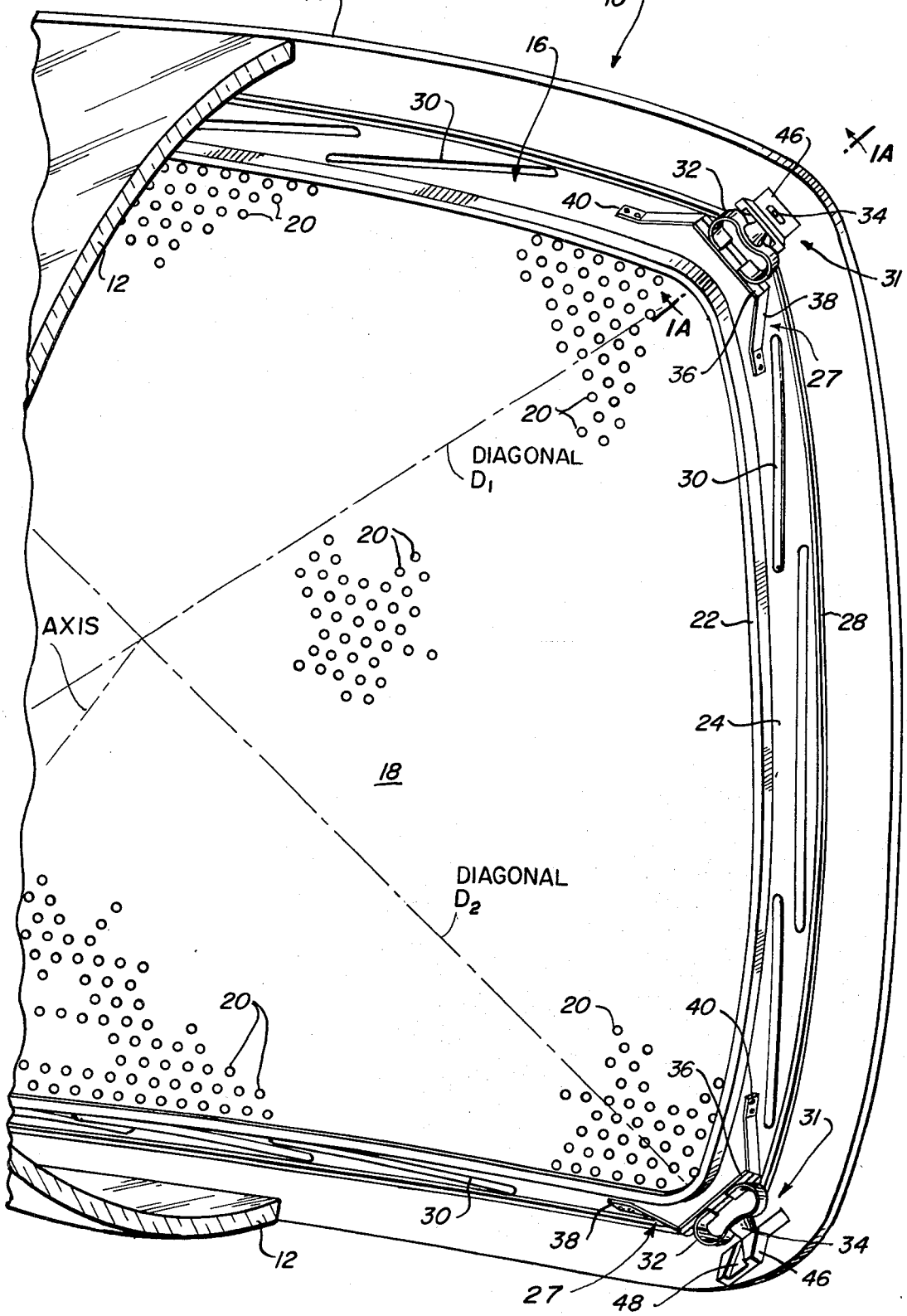
FIG. 1 is a perspective view of a novel color cathode ray tube as seen from the rear, with a portion of the envelope cut away to reveal a shadow mask suspension system implementing the principles of this invention.
Figure 1A:
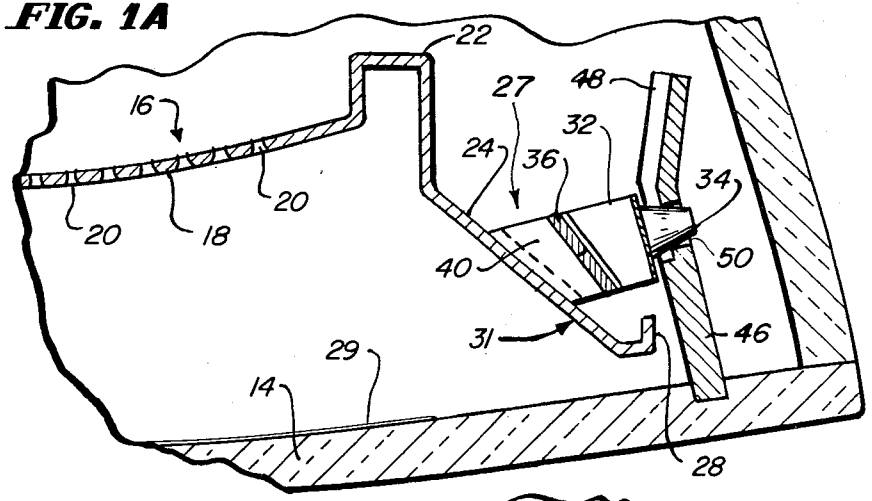
FIG. 1A is a side elevational view, partially sectioned, of a mask suspension device shown in FIG. 1.
Figure 2:
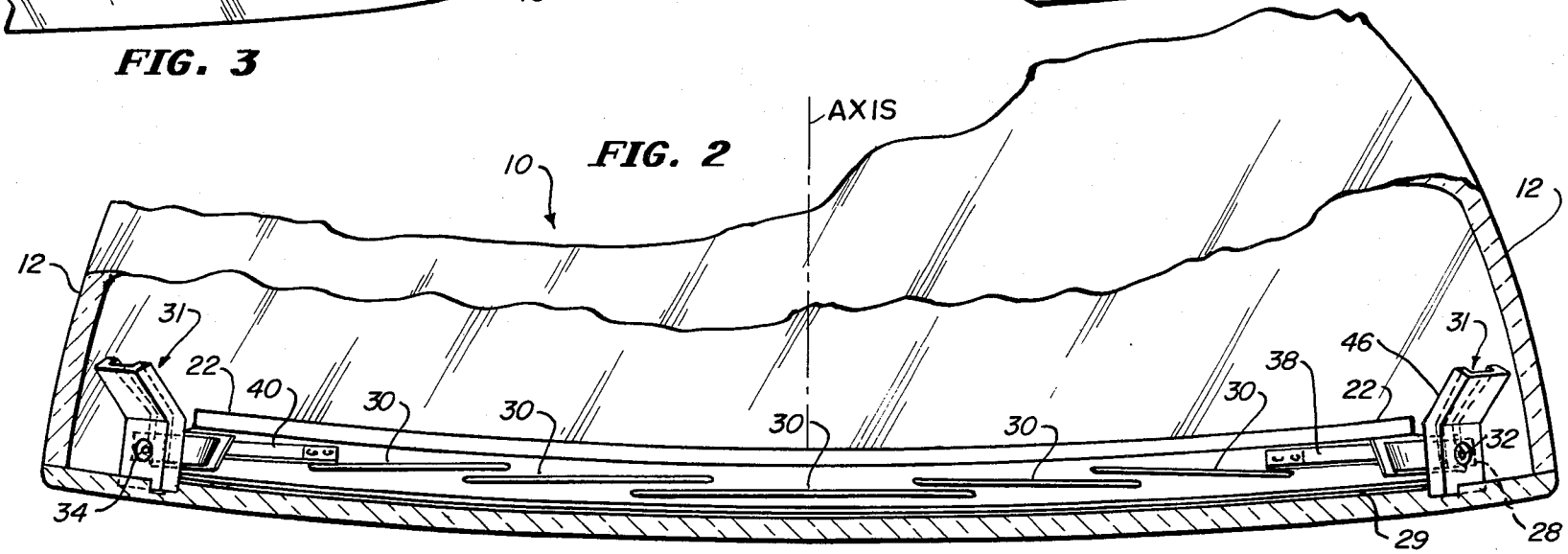
FIG. 2 is an elevational view, partially sectioned, of the FIG. 1 tube showing particularly the shadow mask and its suspension system.
Figure 3:
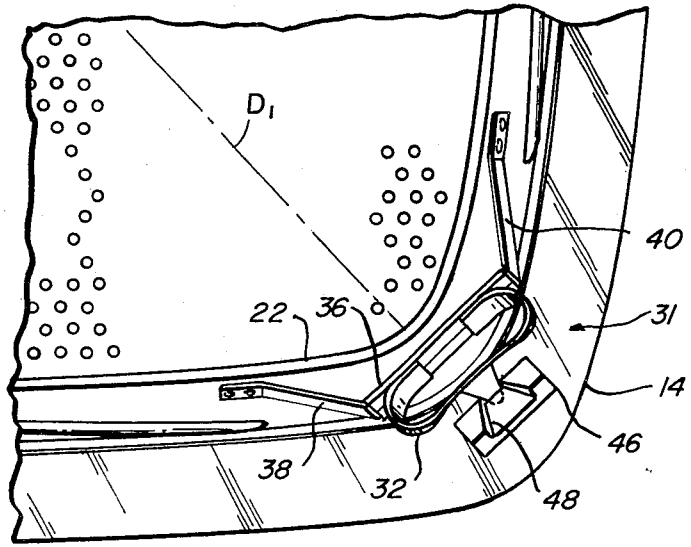
FIG. 3 is a plan view of one of the mask suspension devices illustrated in FIGS. 1 and 2.

This invention is directed to provide an improved shadow mask suspension system which is especially useful for suspending upon the envelope of a color cathode ray tube a lightweight, torsionally flexible shadow mask of a character as described and claimed in the referent copending application Ser. No. 395,334. As used herein, the term "shadow mask" is intended to encompass all tubes, including post deflection focus tubes, in which a color selection mask or electrode achieves a shadowing effect, whether total or only partial. The present suspension system includes four suspension devices, one at each corner of the mask. The general concept, however, of a lightweight, torsionally flexible mask which is supported at its corners so as to permit it to conform to the contour of a cathode ray tube faceplate is described and claimed in the above-noted copending application of K. Palac, Ser. No. 285,985.

FIGS. 1–5 illustrate a color cathode ray tube 10 incorporating a mask suspension system which implements the principles of this invention. The tube 10 is depicted as having an envelope comprising a funnel 12 sealed to a generally rectangular, flangeless front panel or faceplate 14. The tube 10 includes a lightweight, rectangular non-self-rigid, torsionally flexible shadow mask 16 of novel character, as described in detail and claimed in the referent U.S. Pat. No. 3,912,963.

Before engaging in a discussion of the structural details of the mask 16 and its novel suspension system, a brief explanation of certain mask suspension principles underlying this invention will be given, particularly with reference to FIG. 5A. In FIG. 5A there is shown, in partially schematic form, a face plate 14 on which is mounted a shadow mask 16. The suspension system for the shadow mask is shown as comprising four suspension devices 31, one in each corner of the faceplate on a tube diagonal. The preferred structures for the suspension devices 31 will be described in more detail hereinafter. Only those parts of the suspension devices 31 which are pertinent to this discussion of principles will be mentioned at this point.

Each of the suspension devices includes an envelope-mounted component, here shown as a stud 46, having thereon means for coupling the stud to a mask-mounted component of the suspension device. The coupling means is here shown as taking the form of an aperture, the function of which will be described in more detail hereinafter. The suspension devices each also include a mask-mounted component, here shown as comprising a bracket 27 on which is mounted a leaf spring 32. As shown in FIG. 5A, the leaf spring 32 carries provision (here shown as a lug 34) for engaging the coupling means on the envelope-mounted means (here shown as the lug-receiving opening 50 in the stud 46). It is here noted that the functions performed by the mask-mounted and envelope-mounted components may be interchanged, i.e., the spring may be envelope-mounted and the cooperating structure may be mask-mounted.

In the system according to this invention, the faceplate 14 is used, in effect, to impart rigidity to the mask 16. The suspension system acts as a rigid coupling between the faceplate 14 and the mask 16. Yet, by the provision of the spring suspension system, the mask 16 may be demounted and precisely remounted any number of times, as is required during conventional faceplate screening operations.

In accordance with an aspect of this invention, when the spring 32 is deflected the lug 34 on the leaf spring 32 moves to achieve stud disengagement in a plane including a tube diagonal and the mask/tube axis (the mask and the faceplate portion of the envelope being coaxial). By this arrangement, there is suppressed the generation of tangential force components on the mask in the plane thereof which might tend to rotate, mislocate, twist or distort the mask. Stated another way, the generation of purely radial force components on the mask is enhanced.

As shown in FIG. 5A, the said diagonal for the studs 46 in the front left and rear right corners of the faceplate 14 is designated $D_1$. The said plane in which the lug 34 moves when the spring 32 is deflected is designated $P_1$ in FIG. 5A, Line $D_2$ represents the other diagonal; the plane $P_2$ is the plane in which the lugs in the suspension devices in the rear left and front right corners of the FIG. 5A faceplate move when their associated springs 32 are deflected.

Because the non-self-rigid mask 16 lacks structural strength, it is easily warped or twisted about its diagonals. Another important aspect of the suspension system of this invention is the location of the suspension devices at the corners of the electrode 11. By introducing the suspension forces along the diagonals, with the effect that the mask corners are immobilized, the mask is held inflexibly and is precisely positioned with respect to the faceplate 14. Further in accordance with an aspect of this invention, the springs 22 are matched so as to apply a substantially equivalent load at the mask corners to thereby substantially immobilize the geometrical center of the mask upon thermal expansion or contraction thereof. The spring rate of the springs is relatively low so as not to deform the mask.

Details of the construction of the shadow mask 16 and its novel suspension system will now be given. Briefly, the shadow mask in its illustrated form comprises a sheet of electrically conductive material having a curved central portion 18 which has formed therein a pattern of electron-transmissive apertures 20. The mask includes a stiffening portion circumscribing the central portion 18 which causes the mask to be relatively stiff with respect to its major and minor axes yet torsionally flexible with respect to its diagonals. The stiffening portion includes a strengthening channel 22 surrounding and joined with the central portion 18 and a skirt 24. For these details, see FIGS. 1–3.

The skirt 24 is of substantially constant depth and surrounds and is joined with the channel 22. The skirt 24 includes a forwardly directed, outwardly flared body portion terminating in a leading edge portion 28. As described in detail in the referent copending application, the configuration of the strengthening channel 22 and of the skirt 24 is such as to maximize the strength of the mask and to shield, to the maximum degree possible, the phosphor screen 29 on the inner surface of the panel 14 from stray or over-scanned electrons from the electron beams.

The flared body portion of the skirt 24 has formed along each side a plurality of strengthening rib elements 30. The rib elements on each side of the mask are individually straight, mutually parallel and orthogonal to the tube axis. The rib elements 30 are successively offset laterally and arranged such that as a group they follow the contour of the mask central portion 18. Individually they are arranged as sections of chords of the curved contour of the skirt. The strengthening ribs are effective to substantially synthesize a load-bearing beam having an effective load-bearing depth which is greater than the depth of any individual rib element but which is less than the overall depth of the skirt.

This invention is directed to the provision of a color cathode ray tube of the shadow mask type having a novel corner spring suspension system for detachably supporting a shadow mask of the character described.

In general terms, the novel mask suspension system detachably supports the shadow mask at a predetermined spacing from the inner surface of the faceplate and couples the mask and said faceplate such that said faceplate provides rigidity for said mask while permitting said mask to be repeatably removed from and precisely remounted in the tube. The suspension system comprises four suspension devices, one located at each corner of the mask on a diagonal thereof so as to permit the mask to flex about a diagonal, if necessary, to conform to the contour of the inner surface of the faceplate, and yet so as to accurately fix the spatial position thereof relative to the faceplate. At least three, and desirably all four, of said suspension devices include a faceplate-mounted component affixed to the faceplate on a diagonal thereof, and a mask-mounted component secured to the outside of the stiffening portion of the mask. The mask-mounted component preferably includes bracket means and matched leaf spring means on the bracket means having provision for detachably engaging coupling means on the faceplate-mounted component substantially along an electrode diagonal. This provision moves when the leaf spring means is deflected, substantially in a plane which includes said diagonal and the mask axis in order to suppress the generation of tangential force components on the mask in the plane thereof which might tend to rotate, mislocate, twist or distort the mask.

The envelope-mounted means and the mask-mounted means are preferably structured and arranged, in accordance with an aspect of the invention, such that they mate with a snap-in, self-guiding and self-locating engagement. As will become apparent as this description proceeds, the functions of the mask-mounted means and the envelope-mounted means may be interchanged consistent with the principles of this invention.

A more detailed description of the mask and mask suspension structures discussed in general terms above will now be given. FIGS. 1–5 depict a preferred execution of the invention wherein the mask-mounted means comprises spring means in the form of a leaf spring 32 which carries convergent lug means, here shown as a conically tapered lug 34. The leaf spring 32 is supported upon a bracket 27 comprising a bimetal member 36, which is in turn affixed at a corner of the mask 16 by a pair of arms 38, 40 which bridge the corner of the mask and are welded thereto on opposite sides of the corner.

The bimetal member 36 and the functions it performs are described and claimed in copending application Ser. No. 424,018. Briefly, the bimetal member 36 comprises two strips of metal having different coefficients of thermal expansion which are edge-bonded together. The member 36 deflects, when heated, in its own plane. The member 36 is caused to assume an angle relative to the faceplate 14 which is such that the member will have a component of flexure, when heated, which is effective to reduce radial stresses in the mask introduced by thermal expansion of the mask.

In the illustrated FIGS. 1–5 embodiment, the envelope-mounted means is shown as comprising a stud 46 anchored to the faceplate 14. The stud 46 may be embedded in the faceplate 14 in a manner well known in the art, or bonded thereto.

The stud 46 integrally defines a tapered, inclined guide channel 48 for receiving the lug 34 carried by the leaf spring 32 during a mask insertion operation. The guide channel 48 directs the lug into a snap-in, self-locating engagement with an opening 50 constituting a seat for the lug 34.

The spring 32 is preferably of the "broom clip" construction, as shown, which has the property of providing a force-deflection characteristic which is desirably flat, and a relatively low spring rate (e.g., .5-2 pounds) so as not to deform the mask (particularly when in a thermally expanded state).

To mount the mask 16 in the tube 10, the operator, or an automated mask insertion instrumentality, merely orients the mask to correspond to the orientation of the faceplate 14 and translates it along the tube axis until the lugs 34 engage the guide channels 48 in the studs 46. Upon the application of a force on the mask along the tube axis, the springs 32 deflect back and permit the lugs 34 to follow the inclined guide channels 48 into snap-in engagement with the openings 50. Completion of the insertion operation is indicated by the "clicks" which occur as the lugs seat themselves in the openings 50.

It is manifest that the mask suspension system of this invention will permit a shadow mask to be quickly and precisely mountable in a cathode ray tube by a simple "push-click" insertion operation.

As described, because the lugs move, when the spring 32 is depressed, in a plane including the mask axis and a faceplate diagonal, tangential force components on the mask are suppressed.

As pointed out in detail in the referent copending Palac application — in a mask suspension system according to that invention, mask suspension devices are provided at the four corners of the mask, however, only three of the four suspension devices locate the mask in X, Y and Z coordinates. Assuming the tube axis to represent the Z axis, all four of the devices locate the mask in the Z coordinates, i.e., relative to the faceplate whereas only three of the four devices fix the position of the mask in the X and Y coordinates, i.e., in the plane of the mask. The fourth suspension device is redundant in the X-Y plane.

To this end, one of the mask suspension devices, shown in FIG. 5 at the upper right mask corner in FIG. 1, has a guide channel 48 and an opening 50 which are elongated parallel to the faceplate 14 permitting the mask to float in the X-Y plane while affixing its axial spacing from the faceplate 14.

It can be seen in the FIGS. 1–5 embodiment that the leaf spring 32 supports the lug 34 facing outwardly away from the mask 16 and that the guide channel 48 is oriented facing inwardly such that upon mounting of the mask, the leaf spring 32 is biased inwardly to place the mask in compression. FIGS. 6–7 illustrate another embodiment of the invention in which the mask, when mounted, is placed in tension. The advantages of placing the mask in tension will be described after a discussion of the FIGS. 6–7 structure.

The FIGS. 6–7 mask suspension device 56 comprises maskmounted means in the form of an arched leaf spring 58 supported on a bimetal member 60 which is in turn affixed across the corners of a mask 62 by a pair of arms 64, 66. The spring 58 carries a conically tapered, inwardly facing lug 68. The suspension device 56 is similar in structure and function to the device 31 in the FIGS. 1–5 embodiment, with the exception that the leaf spring has a different configuration and supports an inwardly facing lug, rather than a lug which faces outwardly away from the mask.

The FIGS. 6–7 device includes a stud 70 similar to the stud 46 in the FIGS. 1–5 embodiment which is embedded in a faceplate 72. The stud 70 has a guide channel 74 formed integrally therein, at the termination of which is a circular opening 76 for receiving the lug 68 on spring 58. FIG. 7 reveals by the use of broken lines the manner in which the spring is deflected outwardly during a mask-mounting operation as lug 68 is guided by the channel 74 into a self-locating engagement in the openings 76.

As noted above, the FIGS. 6–7 embodiment cause the mask 62 to be placed in tension. By this arrangement, when the mask expands during thermal cycling of the tube during manufacture, or during normal operation of the tube, stresses created in the spring 58 during mounting of the mask are relieved, rather than augmented. As is well known, in the prior art compression suspension arrangements, during thermal cycling operations high stresses are introduced in the mask-mounting spring members which place the mask assembly under high compressive loading.

The compressive stressing of the mask during thermal cycling is of particular concern when considered in connection with lightweight, frameless masks of the type with which this invention is particularly useful. The introduction of high compressive stresses on such masks during thermal cycling is apt to cause a permanent deformation thereof. By the arrangements shown in FIGS. 6–7 wherein the leaf spring 58 engages the stud 70 so as to place the mask 62 in tension, expansion of the mask serves to relieve, rather than to augment, the forces acting upon the mask 62.

Another important feature of the FIGS. 6–7 embodiment is the provision of a leaf spring (58) which is affixed at one end to a bracket and which has at its distal end a provision (here shown as lug 68) for engaging the stud 70. The spring 58 deflects, when stressed, in a plane including a faceplate diagonal and the mask axis to suppress the generation of tangential force components on the mask which might tend to rotate, mislocate, twist or distort the mask.

In the above-discussed embodiments, the mask-mounted means is illustrated as the means which carries the convergent lug means; the faceplate-mounted means has been illustrated as the means defining the lug-receiving seat. It is within the purview of this invention that the functions provided by the faceplate-mounted means and the mask-mounted means be interchannged. FIGS. 8–9 illustrate yet another embodiment of the invention wherein the convergent lug means is carried by the panel and the lug-receiving seat comprises part of the mask-mounted means.

The FIGS. 8–9 mask suspension device 78 is illustrated as comprising a leaf spring 80 mounted upon a bimetal member 82 which is in turn mounted across the corner of a mask 84 by a pair of arms 86, 88. A stud 90 anchored in the front panel 92 carries an outwardly facing, conically-shaped lug 94. In this embodiment, the leaf spring 80 defines a guide channel terminating in a seat for the lug 94. In more detail, the leaf spring 80 has been formed to have a pair of wings 96, 98 which are deflected out of the plane of the spring to define a tapered guide channel for guiding the lug 94 into an opening 100 at the end of the guide channel.

The FIGS. 8–9 embodiment, like the FIGS. 6–7 embodiment, is effective to place the mask, when mounted, in tension rather than in compression. As in the FIGS. 1–5 embodiment, a complete suspension system incorporating devices 78 as shown in FIGS. 8–9 or FIGS. 6–7 would include three devices which fix the position of the mask in space in X, Y and Z coordinates and a fourth device modified to permit the mask to move in X or Y coordinates, but not along the tube axis.

In each of the above-described embodiments, mask suspension systems have been illustrated which are especially adapted for mounting the shadow mask directly upon the faceplate of a color cathode ray tube. The principles of this invention, however, are equally applicable to the mounting of a shadow mask on the flange or skirt of a conventional skirted front panel.

FIG. 10 is a corner cross-sectional view of yet another embodiment, of the invention in which a lightweight mask 102 of the character described above is corner mounted on a skirted front panel 103 by four suspension devices 104 (only one of which is shown). The device 104 is illustrated as comprising mask-mounted means similar to the mask-mounted means shown in the FIGS. 8–9 embodiment, for example, but comprising a leaf spring 106 having a tip portion 108 which is formed so as to be concave outwardly, rather than concave inwardly.

The tip portion 108 has formed therein an aperture 110 adapted to engage a conical tip 112 on lug 114 embedded or otherwise affixed to the skirt portion 116 of the front panel 103. The FIG. 10 embodiment functions in substantially the same manner as the aforedescribed embodiments. To mount mask 102 in the front panel 103, the mask-mounted means and the lug 114 are aligned and the mask is then translated along the tube axis. The mask-mounted means and the lug 114 mate with a snap-in, self-guiding, self-locating arrangement to accurately mount the mask in the tube at a predetermined distance from the faceplate portion 118 of the front panel 103.

The invention is not limited to the particular details of construction of the embodiments depicted and other modifications and applications are contemplated. For example, masks of constructions other than that shown may be suspended using the suspension system of this invention. The structure shown for achieving temperature compensation is illustrative only — other means suitable for achieving temperature compensation may be employed. Other structures for accomplishing the self-locating engagement of the mask and for guiding the mask into its proper location on the tube faceplate or front panel may be employed. Spring means suitable construction may have forms other than is illustrated. Certain other changes may be made in the above-described apparatus without departing from the true spirit and scope of the invention herein involved and it is intended that the subject matter in the above depiction shall be interpreted as illustrative and not in a limiting sense.

What is claimed is:

1. For use in a color cathode ray tube having an envelope which includes an approximately rectangular, flangeless, curved faceplate supporting on a concave inner surface thereof in a central region a phosphor screen comprising a pattern of red-emissive, blue-emissive and green-emissive phosphor triads, said faceplate being subject, due to its flangeless rectangular configuration, to twist-wise deformations in its configuration which may occur with respect to its diagonals, the combination comprising:

an approximately rectangular non-self-rigid shadow mask having a curved central portion containing a pattern of electron-transmissive apertures registerable with said pattern of phosphor triads and a stiffening portion circumscribing said central portion, said stiffening portion permitting said mask to flex with respect to its diagonals; and a mask suspension system for supporting said shadow mask at a predetermined spacing from said inner surface of said faceplate portion, comprising four suspension devices, one at each corner of the faceplate portion, for mechanically coupling said mask to said envelope such that said mask can flex about a diagonal, if necessary, to conform to the contour of said faceplate, at least three of said suspension devices including a metal stud on said faceplate in a corner region thereof on an area of said concave inner surface which extends outwardly beyond said phosphor screen, and a mask-mounted component on the outside of said stiffening portion of said mask, said mask-mounted component including spring means having provision for retentively engaging said stud.

2. The apparatus defined by claim 1 wherein said mask-mounted component includes an edge-bonded bimetallic component which deflects when heated to cause said mask to be displaced toward said faceplate.

3. The apparatus defined by claim 1 wherein said mask-mounted component includes a bracket secured to said stiffening portion of said mask so as to extend around a corner on the outside thereof, said spring means comprising a leaf spring attached at one end to said bracket and having at its distal end said provision for engaging said stud.

4. For use in a color cathode ray tube having an envelope which includes an approximately rectangular, flangeless, curved faceplate supporting on a concave inner surface thereof in a central region a phosphor screen comprising a pattern of red-emissive, blue-emissive and green-emissive phosphor triads, said faceplate being subject, due to its flangeless rectangular configuration, to twist-wise deformations in its configuration which may occur with respect to its diagonals, the combination comprising:

a rectangular, non-self-rigid shadow mask having a central portion of curvature related to that of the faceplate and containing a pattern of electron-transmissive apertures, said shadow mask also having a stiffening portion circumscribing said central portion causing said mask to be relatively stiff with respect to its major and minor axes, yet relatively torsionally flexible with respect to its diagonals; and a mask suspension system for detachably supporting said shadow mask at a predetermined spacing from said inner surface of said faceplate, comprising four suspension devices, one at each corner of the faceplate, for mechanically coupling said shadow mask to said faceplate such that said mask can flex about a diagonal, if necesary, to conform to the contour of said faceplate, at least three of said suspension devices including a faceplate-mounted component on a diagonal of said faceplate on an area of said concave inner surface of said faceplate which extends outwardly beyond said phosphor screen, and including a mask-mounted component on the outside of said stiffening portion of said mask, one of said mask-mounted and faceplate-mounted components including leaf spring means having provision for detachably engaging coupling means on the other of said mask-mounted and faceplate-mounted components substantially along a mask diagonal, said provision moving when said leaf spring means is deflected substantially in a plane which includes said diagonal and the mask axis in order to suppress the generation of tangential force components on the mask in the plane thereof which might tend to rotate, mislocate, twist or distort the mask.

5. The apparatus defined by claim 4 wherein said mask-mounted component includes a bracelet secured to said stiffening portion of said mask so as to extend around a corner on the outside thereof, said leaf spring means being attached at one end to said bracket and having at its distal end said provision for detachably engaging said faceplate-mounted component.

6. The apparatus defined by claim 5 wherein said faceplate-mounted component comprises a metal stud affixed to said faceplate and having an aperture oriented on said diagonal, and wherein said leaf spring means carries a lug for making engagement in said aperture in said stud along said diagonal.

7. For use in a color cathode ray tube having an envelope which includes a curved faceplate portion supporting on an inner surface thereof, in a central region, a phosphor screen comprising a pattern of red-emissive, blue-emissive and green-emissive phosphor element triads, the combination comprising:

a rectangular, non-self-rigid shadow mask having a central portion of curvature related to that of the faceplate portion and containing a pattern of electron-transmissive apertures, said shadow mask also having a stiffening portion circumscribing said central portion causing said mask to be relatively stiff with respect to its major and minor axes, yet relatively torsionally flexible with respect to its diagonals; and a mask suspension system for detachably supporting said shadow mask at a predetermined spacing from said inner surface of said faceplate portion, comprising four suspension devices, one at each corner of the faceplate portion, for mechanically coupling said shadow mask to said envelope, each of said suspension devices including an envelope-mounted component affixed to said envelope on a diagonal of said faceplate portion and a mask-mounted component secured to the outside of said stiffening portion of said mask, said mask-mounted component including bracket means mounted on the outside of said stiffening portion of said mask and a leaf spring connected at one end to said bracket means, the distal end of said spring having provision for detachable engaging coupling means on said envelope-mounted component substantially along a mask diagonal, said leaf spring means deflecting, when stressed, substantially in a plane which includes said diagonal and the mask axis in order to suppress the generation of tangential force components on the mask in the plane thereof which might tend to rotate, mislocate, twist or distort the mask.

8. For use in a color cathode ray tube having an envelope which includes a curved faceplate portion supporting on an inner surface thereof, in a central region, a phosphor screen comprising a pattern of red-emissive, blue-emissive and green-emissive phosphor element triads, the combination comprising:

a rectangular, non-self-rigid shadow mask having a central portion curvature related to that of the faceplate portion and containing a pattern of electron-transmissive apertures, said shadow mask also having a stiffening portion circumscribing said central portion causing said mask to be relatively stiff with respect to its major and minor axes, yet relatively torsionally flexible with respect to its diagonals; and a mask suspension system for detachably supporting said shadow mask at a predetermined spacing from said inner surface of said faceplate portion, comprising four suspension devices, one at each corner of the faceplate portion, for mechanically coupling said shadow mask to said envelope, each of said suspension devices including an envelope-mounted component affixed to said envelope on a diagonal of said faceplate portion and a mask-mounted component secured to the outside of said stiffening portion of said mask, said mask-mounted component including leaf spring means having provision for detachably engaging coupling means on said envelope-mounted component substantially along a mask diagonal, said provision moving when said leaf spring means is deflected substantially in a plane which includes said diagonal and the mask axis in order to suppress the generation of tangential force components on the mask in the plane thereof which might tend to rotate, mislocate, twist or distort the mask, three of said suspension devices fixing in the plane of the mask the spatial position of the mask relative to said inner surface of said faceplate portion and a redundant fourth suspension device having provision for permitting the fourth corner of the mask to seek an equilibrium position in said plane of the mask.

9. The apparatus defined by claim 8 wherein said mask-mounted component includes a bracket secured to said stiffening portion of said mask so as to extend around a corner on the outside thereof, said leaf spring means being attached at one end of said bracket and having at its distal end said provision for detachably engaging said envelope-mounted conponent.

10. The apparatus defined by claim 9 wherein said envelope-mounted component comprises a metal stud affixed to said faceplate portion and having an aperture oriented on said diagonal, and wherein said leaf spring means carries a lug for making engagement in said aperture in said stud along said diagonal.

11. The apparatus defined by claim 10 wherein said redundant fourth suspension device is like the other three devices except that the aperture in said stud is a slot elongated in a direction transverse to said diagonal but parallel to said faceplate portion.

12. In a color cathode ray tube, the combination comprising:

a rectangular, rigid, flangeless, three-dimensionally curved glass faceplate having a concave inner surface supporting in a central region thereof a phosphor screen comprising a pattern of red-emissive, blue-emissive and green-emissive phosphor triads;

a lightweight, rectangular, non-self-rigid shadow mask having a central portion of curvature related to that of the faceplate and containing a pattern of electron-transmissive apertures, said shadow mask also having a stiffening portion circumscribing said central portion causing said mask to be relatively stiff with respect to its major and minor axes, yet relatively torsionally flexible with respect to its diagonals;

a mask suspension system for detachably supporting said shadow mask at a predetermined spacing from said inner surface of said faceplate and for coupling said mask and said faceplate such that said faceplate provides rigidity for said mask while permitting said mask to be repeatably removed from and precisely remounted in the tube, said suspension system comprising four suspension devices, one located at each corner of the mask on a diagonal thereof so as to permit the mask to flex about a diagonal, if necessary, to conform to the contour of the inner surface of the faceplate, and yet so as to accurately fix the spatial position thereof relative to the faceplate, each of said suspension devices including a faceplate-mounted component affixed to said faceplate on a diagonal thereof, and a mask-mounted component secured to the outside of said stiffening portion of said mask, said mask-mounted component including bracket means and leaf spring means on said bracket means having provision for detachably engaging coupling means on said faceplate-mounted component substantially along a mask diagonal, said provision moving when said leaf spring means is deflected, substantially in a plane which includes said diagonal and the mask axis in order to suppress the generation of tangential force components on the mask in the plane thereof which might tend to rotate, mislocate, twist or distort the mask.

13. The apparatus defined by claim 12 wherein said faceplate-mounted component comprises a metal stud affixed to said faceplate and having an aperture oriented on said diagonal, and wherein said leaf spring means carries a lug for making engagement in said aperture in said stud.

14. The apparatus defined by claim 13 wherein three of said suspension devices fix in the plane of the mask the spatial position of the mask relative to said inner surface of said faceplate and a redundant fourth suspension device has provision for permitting the fourth corner of the mask to seek an equilibrium position in the said plane of the mask.

15. The apparatus defined by claim 14 wherein said redundant fourth suspension device is like the other three devices except that the aperture in said stud is a slot elongated in a direction transverse to said diagonal but parallel to said faceplate.

16. For use in a color cathode ray tube, a mask suspension system for supporting a shadow mask on the envelope of the tube including a plurality of mask suspension devices spaced around the mask, each comprising:

envelope-mounted means for supporting said mask secured in a precise location upon the inside of the envelope; and mask-mounted means for retentively but detachably engaging said envelope-mounted means to cause said mask to assume a fixed position in space relative to said envelope, said envelope-mounted means and said mask-mounted means mating with a snap-in, self-guiding and self-locating engagement such that said mask is quickly and precisely mountable in the tube by a push-click insertion operation.

17. The system defined by claim 16 wherein one of said mask-mounted means and said envelope-mounted means includes convergent lug means, and the other of said mask-mounted means and said envelope-mounted means includes a seat for receiving and precisely locating said convergent lug means in a predetermined position.

18. The system defined by claim 17 wherein other of said mask-mounted means and said envelope-mounted means includes means defining a tapered guide channel for receiving said convergent lug means and for guiding it into said seat.

19. The system defined by claim 18 wherein said mask-mounted means includes spring means carrying said convergent lug means and wherein said envelope-mounted means includes a stud which has an opening constituting said seat for receiving said lug means and which defines said guide channel for guiding said lug means against the restorative force of said spring into snap-in engagement in said opening.

20. The system defined by claim 18 wherein said one of said mask-mounted means and said envelope-mounted means includes spring means supporting said convergent lug means.

21. The system defined by claim 20 wherein said guide chennel and said lug means are oriented such that upon mounting of the mask on the envelope, said spring means is biased so as to place the mask in tension.

22. The system defined by claim 21 wherein said mask-mounted means includes said spring means and wherein said envelope-mounted means includes a stud which has an opening constituting said seat for receiving said lug means and which defines said guide channel for guiding said lug means against the restorative force of said spring means and into snap-in engagement in said opening.

23. The system defined by claim 20 wherein said guide channel and said lug means are oriented such that upon mounting of the mask on the envelope, said spring means is biased so as to place the mask in compression.

24. The system defined by claim 23 wherein said mask-mounted means includes said spring means and wherein said envelope-mounted means includes a stud which has an opening constituting said seat for receiving said lug means and which defines said guide channel for guiding said lug means against the restorative force of said spring means and into snap-in engagement in said opening.

25. In a color cathode ray tube, the combination comprising:

an envelope including a funnel and a substantially rectangular, skirtless faceplate sealed therewith;

a substantially rectangular shadow mask formed from a sheet of electrically conductive material and having therein a pattern of electron-transmissive apertures; and a mask suspension system for supporting said shadow mask on said faceplate including four mask suspension devices, one at each corner of the mask, at least three of said devices comprising:

faceplate-mounted means for supporting said mask secured in a precise location upon the inside of the faceplate, and mask-mounted means for retentively but detachably engaging said faceplate-mounted means to cause said mask to assume a fixed position in space relative to said faceplate, said faceplate-mounted means and said mask-mounted means mating with a snap-in self-guiding and self-locating engagement such that said mask is quickly and precisely mountable in the tube by a push-click insertion operation.

26. The combination defined by claim 25 wherein one of said mask-mounted means and said faceplate-mounted means includes convergent lug means and the other of said mask-mounted means and said faceplate-mounted means includes a seat for receiving and precisely locating said convergent lug means in a predetermined position.

27. The combination defined by claim 26 wherein other of said mask-mounted means and said faceplate-mounted means includes means defining a tapered guide channel for receiving said convergent lug means and for guiding it into said seat.

28. The combination defined by claim 27 wherein said mask-mounted means includes leaf spring means carrying said convergent lug means and wherein said faceplate-mounted means includes a stud which has an opening constituting said seat for receiving said lug means and which defines said guide channel for guiding said lug means against the restorative force of said spring into snap-in engagement in said opening.

29. The combination defined by claim 27 wherein said one of said mask-mounted means and said faceplate-mounted means includes resilient leaf spring means supporting said convergent lug means.

30. The combination defined by claim 29 wherein said guide channel and said lug means are oriented such that upon mounting the mask upon the faceplate, said leaf spring means is biased so as to place the mask in tension.

31. The combination defined by claim 30 wherein said mask-mounted means includes said leaf spring means and wherein said faceplate-mounted means includes a stud which has an opening constituting said seat for receiving said lug means and which defines said guide channel for guiding said lug means against the restorative force of said spring means into snap-in engagement in said opening.

32. The combination defined by claim 29 wherein said guide channel aand said lug means are oriented such that upon mounting of the mask upon the faceplate, said leaf spring means is biases so as to place the mask in compression.

33. The combination defined by claim 28 wherein in said system, in three of said suspension devices said seat in said stud has a circular seating area and wherein the fourth device is similar to said three devices but comprises a faceplate-mounted stud having a seating area elongated in a direction parallel to said faceplate such that said fourth device fixes the spacing of the mask from the faceplate while permitting the mask freedom of movement parallel to the faceplate.

34. The combination defined by claim 25 wherein said mask is frameless and includes a forwardly directed, outwardly flared skirt and wherein said mask-mounted means is secured to said flared skirt.

35. In a color cathode ray tube, the combination comprising:

an envelope including a funnel and a substantially rectangular, skirtless faceplate sealed therewith;

a substantially rectangular shadow mask formed from a sheet of electrically conductive material and having therein a pattern of electron-transmissive apertures; and a mask suspension system for supporting said shadow mask on said faceplate of the tube including four mask suspension devices, one at each corner of the mask, at least three of said devices comprising:

a stud for supporting the mask, secured in a precise location upon the inside of the faceplate, said stud defining a seat and a guide channel leading to said seat, and mask-mounted means including spring means supporting convergent lug means adapted to be received in said guide channel during a mask mounting operation and to follow said guide channel into a snap-in, self-locating engagement with said seat to thereby cause said mask to assume a predetermined fixed position in space relative to said stud and to said faceplate, said mask being quickly and precisely mountable in the tube by a push-click insertion operation.

36. The combination defined by claim 35 wherein said spring means supports said lug means facing inwardly toward said mask and wherein said channel is oriented such that, upon mounting of the mask in the tube, said spring means is biased outwardly so as to place the mask in tension.

37. The combination defined by claim 35 wherein said spring means supports said lug means facing outwardly away from the mask and wherein said channel is oriented such that, upon mounting of the mask in the tube, said spring means is biased inwardly so as to place the mask in compression.

38. The combination defined by claim 35 wherein in said three suspension devices said seat in said stud has a circular seating area and wherein the fourth device is similar to said three devices, but comprises a faceplate-mounted stud having a seating area elongated parallel to said faceplate so that said fourth device fixes the spacing of the mask from the faceplate while permitting the mask freedom of movement parallel to the faceplate.

39. The combination defined by claim 35 wherein said mask is frameless and flexible and includes a forwardly directed, outwardly flared skirt, and wherein said mask-mounted means is secured to said flared skirt.

40. For use in a color cathode ray tube a mask suspension system for supporting a shadow mask on a faceplate of the tube including a plurality of mask suspension devices spaced around the mask comprising:

faceplate-mounted means for supporting said mask secured in a precise location upon the inside of the faceplate; and mask-mounted means for retentively but detachably engaging said faceplate-mounted means to cause said mask to assume a fixed position in space relative to said faceplate, one of said mask-mounted means and said faceplate-mounted means including spring means supporting a convergent lug means and the other of said mask-mounted means and said faceplate-mounted means including a seat for receiving and precisely locating said covergent lug means in a predetermined position, said faceplate-mounted means and said mask-mounted means mating such that said spring means places said mask under tension.

41. In a color cathode ray tube, the combination comprising:

an envelope including a funnel and a substantially rectangular, skirtless faceplate sealed therewith;

a substantially rectangular shadow mask formed from a sheet of electrically conductive material and having therein a pattern of electron-transmissive apertures; and a mask suspension system for supporting said shadow mask on said faceplate of the tube including four mask suspension devices, one at each corner of the mask, at least three of said devices comprising:

a stud for supporting the mask secured in a precise location upon the inside of the faceplate, said stud defining a seat facing outwardly from said mask, and mask-mounted means including spring means supporting convergent lug means facing inwardly toward said mask and adapted to be received in self-locating engagement with said seat to cause said mask to be placed in tension and to assume a predetermined fixed position in space relative to said stud and to said faceplate.

42. In a color cathode ray tube, the combination comprising:

an envelope including a funnel and sealed therewith a substantially rectangular front panel having a faceplate portion and a rearwardly directed skirt portion;

a substantially rectangular shadow mask formed from a sheet of electrically conductive material and having therein a pattern of electron-transmissive apertures; and a mask suspension system for supporting said shadow mask on said skirt portion of said front panel which includes four mask suspension devices, one at each corner of the mask, at least three of said devices comprising:

panel-mounted means for supporting said mask secured in a precise location upon the inside of the skirt portion of said front panel, and mask-mounted means for retentively but detachably engaging said panel-mounted means to cause said mask to assume a fixed position in space relative to said faceplate portion of said front panel, said panel-mounted means and said mask-mounted means mating with a snap-in, self-guiding and self-locating engagement such that said mask is quickly and precisely mountable in the tube by a push-click insertion operation.

43. The combination defined by claim 42 wherein said panel-mounted means includes convergent lug means and said mask-mounted means includes a leaf spring having formed therein an aperture and a lug guide channel leading to said aperture for receiving and guiding said lug means into snap-in engagement with said aperture.

* * * * *

UNITED STATES PATENT OFFICE

CERTIFICATE OF CORRECTION

Patent No. 3,943,399 Date March 9, 1976

Inventor(s) Stanley J. Sedivy

It is certified that error appears in the above-identified patent and that said Letters Patent are hereby corrected as shown below:

In column 2, line 63, "may" should be --must--;

In column 3, line 8, "configuration" should be --configurational--;

In column 3, line 24, "is" should be --was--;

In column 11, line 14, before "suitable" insert --of--.

In column 11, line 42, after "faceplate" delete --portion--;

In column 11, line 44, after "plate" delete --portion--;

In column 14, line 9, "conponent" should be --component--;

In column 15, line 59, "chennel" should be --channel-- and

In column 17, line 10, "aand" should be --and--.

Signed and Sealed this

Twelfth Day of October 1976

[SEAL]

*Attest:*

RUTH C. MASON
*Attesting Officer*

C. MARSHALL DANN
*Commissioner of Patents and Trademarks*